US005472321A

United States Patent [19]

Radermacher

[11] Patent Number: 5,472,321

[45] Date of Patent: Dec. 5, 1995

[54] FUEL PUMP HAVING AN IMPELLER WITH AXIALLY BALANCED FORCES ACTING THEREON

[75] Inventor: Bernhard Radermacher, Viersen, Germany

[73] Assignee: Pierburg GmbH, Neuss, Germany

[21] Appl. No.: 171,335

[22] Filed: Dec. 20, 1993

[30] Foreign Application Priority Data

Dec. 19, 1992 [DE] Germany ..... 42 43 225.1

[51] Int. Cl.[6] ..... F04B 39/06; F04B 17/00

[52] U.S. Cl. ..... 417/365; 417/366; 417/423.1; 415/55.6; 415/106

[58] Field of Search ..... 417/423.1, 423.3, 417/423.5, 473.8, 244, 366, 365; 415/55.5, 55.6, 55.7, 106

[56] References Cited

U.S. PATENT DOCUMENTS

| | | | |
|---|---|---|---|
| 4,449,891 | 5/1984 | Kemmner | 417/423 R |
| 4,451,213 | 5/1984 | Takei et al. | 417/423.3 |
| 4,466,781 | 8/1984 | Kemmner et al. | 417/366 |
| 4,556,363 | 12/1985 | Watanabe et al. | 415/53 T |
| 4,573,882 | 3/1986 | Watanabe et al. | 417/366 |
| 4,586,877 | 5/1986 | Watanabe | 417/366 |
| 4,678,395 | 7/1987 | Schweinfurter | 415/55.6 |
| 4,784,587 | 11/1988 | Takei et al. | 417/423.1 |
| 4,854,830 | 8/1989 | Kuzawa et al. | 417/365 |
| 5,173,037 | 12/1992 | Martin et al. | 417/423.3 |

*Primary Examiner*—Timothy S. Thorpe
*Assistant Examiner*—Peter G. Korytnyk
*Attorney, Agent, or Firm*—Ladas & Parry

[57] ABSTRACT

An improvement in a fuel pump for an internal combustion engine in which the fuel pump comprises an electric motor over which fuel is pumped to cool the motor, and a pump mechanism, constituted as a side-channel pump driven by the electric motor, pumps the fuel. The pump mechanism has a pump impeller provided with two opposite radial surfaces each provided with an annular ring of blades respectively cooperating with side channels provided in a pump wall to constitute first and second pump stages. A connecting channel connects an inlet region of the side channel of the second pump stage with a discharge region of the side channel of the first pump stage in an arrangement to substantially eliminate torsional moments acting on the impeller during a fuel pumping operation. A first flat region is formed on the radial surface of the pump impeller in the first pump stage and a second flat region is formed on the radial surface of the pump impeller in the second pump stage. The pressure of the fluid discharged from the second pump stage is applied to the first flat region, and the pressure of the fluid discharged from the first pump stage is applied to the second flat region so that a net axial force applied to the first and second flat regions of the pump impeller by the respective pressures of the fluid in the first and second stages substantially counterbalances a force produced on the pump impeller by the pressure of the discharged fluid acting in the direction of the first pump stage.

14 Claims, 4 Drawing Sheets

FUEL PUMP HAVING AN IMPELLER WITH AXIALLY BALANCED FORCES ACTING THEREON

FIELD OF THE INVENTION

The invention relates to a fuel pump for an internal combustion engine and more particularly to a fuel pump having a pump mechanism driven by an electric motor, said pump mechanism being constituted as a side-channel pump driven by the electric motor.

The pump mechanism includes a pump impeller provided with two opposite radial surfaces, each having an annular ring of blades respectively cooperating with side channels provided in opposing surfaces of a wall of the pump. The ring of blades and one side channel constitutes a first pump stage and the ring of blades and the other side channel constitutes a second pump stage. A discharge region of the side channel of the first pump stage is connected by a connecting channel to an inlet region of the side channel of the second pump stage, said inlet region and said discharge region being arranged to substantially eliminate torsional moments acting on the pump impeller during a fuel pumping operation.

BACKGROUND AND PRIOR ART

A fuel pump of the above type is disclosed in DE-A 1 31 18 533. However, in this pump a uniform axial load remains on the pump impeller due to the delivery pressure of the first pump stage in the direction of the first pump stage, and the axial load is resisted by an appropriate bearing mechanism. Additionally, in this pump the pump impeller is loosely mounted on an armature shaft of the motor and the impeller is driven by a driver on the armature. In this way the impeller engages under load against the facing walls of the pump whereby high friction forces are produced causing torsional forces, wear, and in some cases loud objectionable noise.

SUMMARY OF THE INVENTION

An object of the invention is to provide a pump of the above type which avoids the problems with the known pump and which operates with minimum noise and is simple to manufacture.

A further object of the invention is to provide a fuel pump in which the axial forces acting on the pump impeller are balanced.

The above and further objects of the invention are achieved by providing first and second flat regions on the radial surfaces of the pump impeller in the first and second pump stages and providing connection means for applying the pressure of the fluid discharged from the second pump stage to the first flat region in the first pump stage and for applying the pressure of the fluid discharged from the first pump stage to the second flat region of the second pump stage. The forces applied to the flat regions are adjusted (by the areas of the flat regions) so that a net axial force is applied to the pump impeller which substantially counterbalances the force produced on the pump impeller by the pressure of fluid discharged from the first pressure stage acting in the direction of the first pump stage.

In order to provide the connection between the flat region of the second pump stage with the delivery pressure of the fluid from the first pump stage, both side channels are provided with ramp-like extensions which communicate with a connecting channel and an additional channel connects the ramp-like extension of the side channel of the second stage with said flat region of the second stage.

DETAILED DESCRIPTION OF A PREFERRED EMBODIMENT

Figure 1:
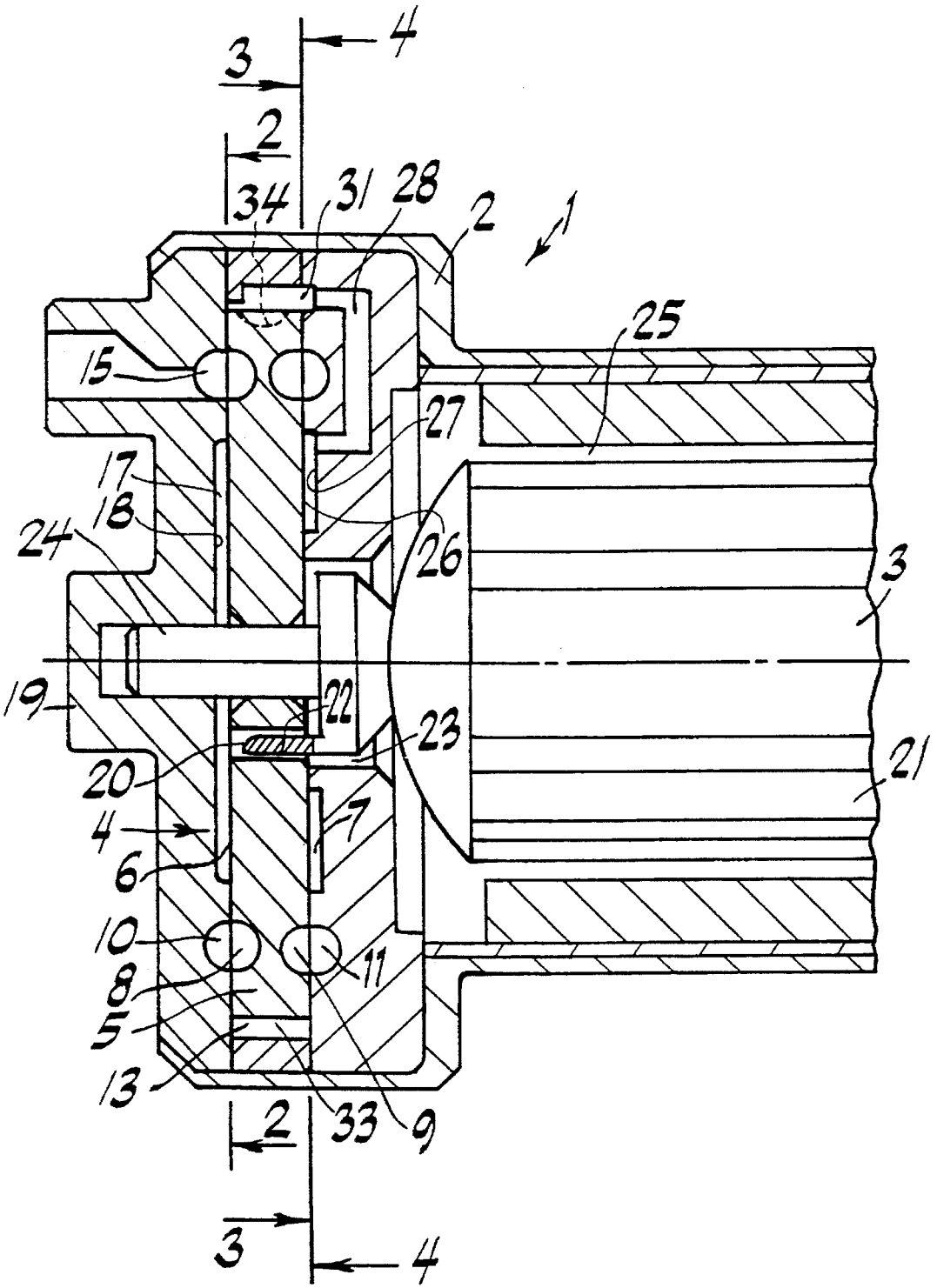
FIG. 1 is a longitudinal section of a portion of a fuel pump according to the invention.

FIG. 1 shows a fuel pump 1 comprising a housing 2, an electric motor 3, and a pump mechanism 4. Pump mechanism 4 is in the form of a side channel pump, whose pump impeller 5 has annular rings of blades 8, 9 on opposite radial faces 6, 7 thereof which cooperate with respective side channels 10, 11 provided in each of two facing surfaces of a wall 19 of the pump to pump fuel. A discharge region 12 (FIG. 2) of the first channel 10 or first stage of the pump mechanism is connected by a connecting channel 13 to an inlet region 14 of the second channel 11 or second pump stage of the pump mechanism. The discharge region 12 and the inlet region 14 of the two pump stages are arranged such that no torsional moments act on faces 6, 7 during the fuel pumping operation. In this respect when viewed in the axial direction of pump impeller 5, an inlet 15 of the first pump stage lies opposite the inlet region 14 of the second pump stage, and the discharge region 12 of the first pump stage lies opposite a discharge outlet 16 of the second pump stage, whereby the summation of moments produced by the fluid forces around the axis of rotation of the pump impeller is zero.

Pump impeller 5 is provided with a flat region 17 on face 6 of the first pump stage, said flat region 17 being bounded by a recess 18 provided in pump wall 19. The recess 18 communicates via slots 20 provided in pump impeller 5 with a recess 23 which communicates with a chamber 25 accommodating the electric motor 3. The discharge outlet 16 of the second pump stage is connected to chamber 25 to pump fuel around the motor 3 to cool the motor. A driver 22 on motor armature 21 extends into one of the slots 20 with radial clearance to drivingly couple the impeller 5 and the motor in rotation. An armature shaft 24 is loosely supported in pump 5. Since the fuel in chamber 25 is subjected to the discharge pressure of the second pump stage, the flat region 17 of the first stage is also subjected to this pressure and an axial force is applied to the pump impeller 5.

Figure 3:
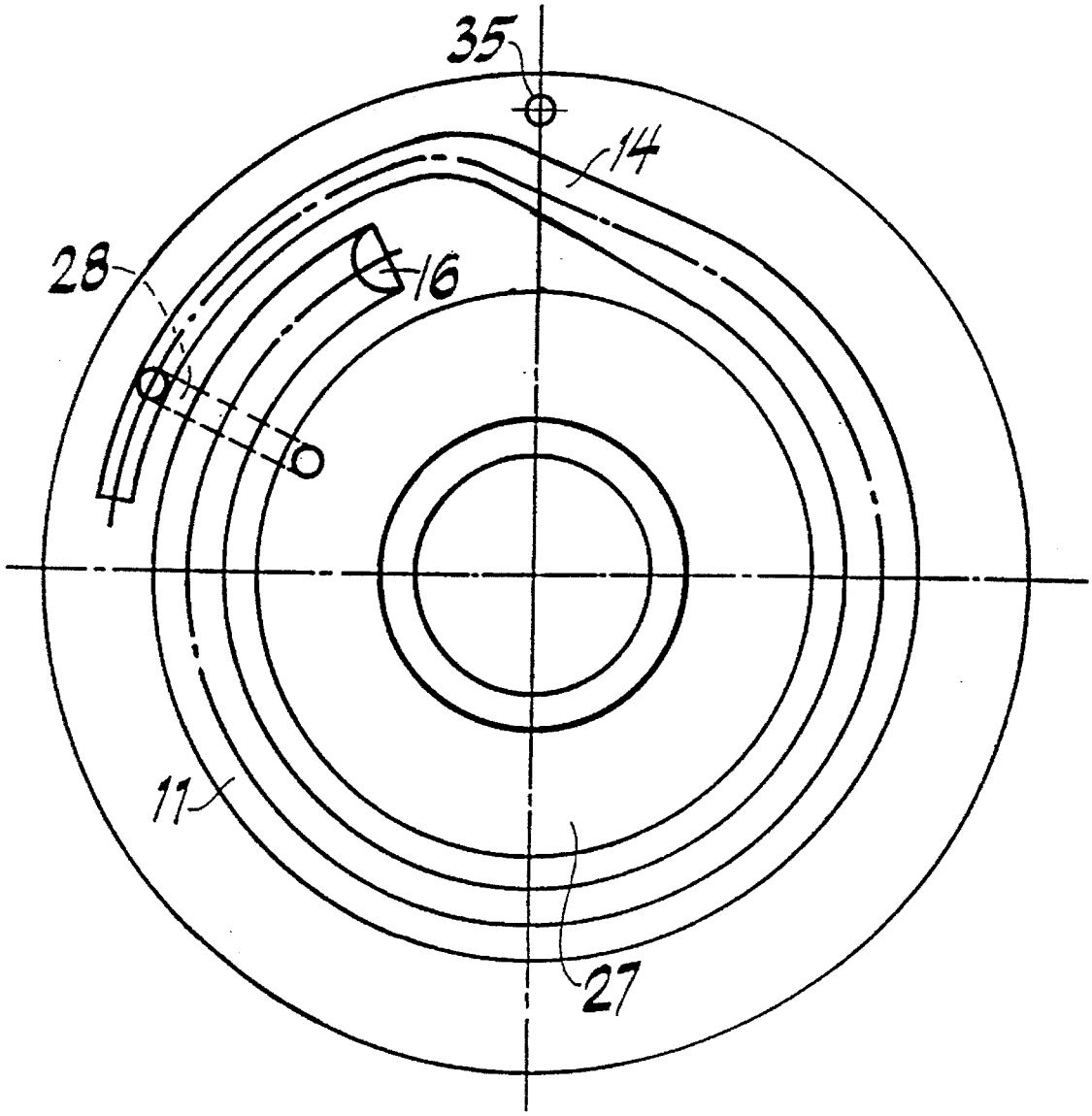

A flat region 26 is also provided on radial face 7 of the second pump stage, and the flat region 26 is bounded by a recess 27 provided in pump wall 19. The recess 27 is connected to receive the discharge pressure of the fluid of the discharge region 12 of the first pump stage such that the flat region 26 of the second pump stage is subjected to the discharge pressure of the first pump stage. The connection of recess 27 to the flat region 26 is effected by providing a channel 28 in the form of a bore in the pump wall 19 but the connection may also be formed as a groove 28' as shown in FIG. 3 in chain-dotted lines. In this way, axial forces are applied to both side faces of pump impeller 5 during a pumping operation, and by selection of the areas of the flat regions 17, 26, the net axial force on the impeller 5 can be made approximately equal to the force applied in the direction of the first pump stage by the delivery pressure of the first pump stage. In this way the pump impeller 5 can be loosely mounted on motor armature shaft 24 without fear of axial displacement since substantially no resultant axial forces are applied to pump impeller 5.

The connecting channel 13 between the discharge region of the first pump stage and the inlet region of the second pump stage is formed by a radial extension 29 of a bore 30 in the pump wall which rotatably receives the impeller 5. The discharge region 12 of the first side channel 10 and the inlet region 14 of the second side channel 11 are connected to connecting channel 13 by ramp-like extensions formed by intermediate channels 31 (FIGS. 2 and 3), which communicate with complementary channels 32 formed in the pump wall 19. The channels 31, 32 are disposed radially outward of the side channels 10, 11 and channels 32 connect to the radial extension 29.

A favorable delivery flow can be produced by these measures. In particular, due to the fact that the walls of the connecting channel 13 are partially formed by the outer surface 33 of pump impeller 5 and because the surface of the pump impeller moves in the direction of the fuel delivery, the fuel flow is promoted by the friction between the fuel and the surface 33. The friction can be increased by providing a friction producing means on the outer surface of the pump impeller 5 in the form of a blade ring 34 on the surface 33 of pump impeller 5.

Figure 2:
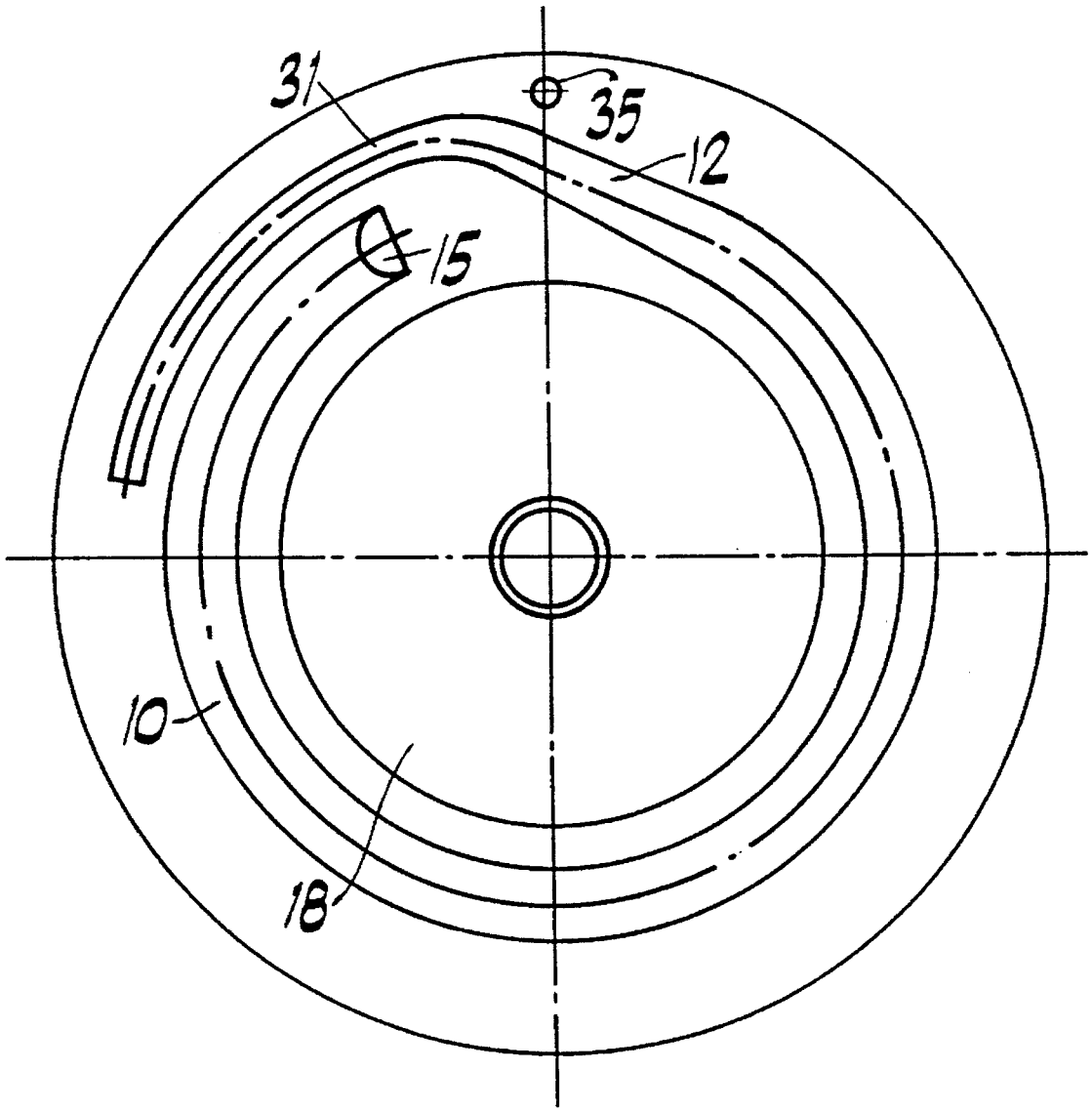
FIGS. 2, 3 and 4 are respective diagrammatic sectional views taken along lines 2—2, 3—3 and 4—4 in FIG. 1.

FIGS. 2 and 3 are side views of the walls of the pump impeller, illustrating, in FIG. 2, the first side channel 10 with inlet region 15 and discharge region 12. Discharge region 12 connects to intermediate channel 31 by the radially outward ramp-like extension from the side channel 10. The channel 31 is connected to connecting channel 13 (FIG. 4) via channel 32.

FIG. 3 shows that the second side channel 11 is identical in configuration to the first side channel 10, but rotated with respect to a reference point 35. In other words, in the assembled state of the pump, the surfaces shown in FIGS. 2 and 3 face one another. Thereby, when viewed in the axial direction of pump impeller 5, the inlet 15 of the first pump stage lies opposite the inlet region 14 of the second pump stage and the discharge outlet 16 of the second pump stage lies opposite the discharge region 12 of the first pump stage.

Figure 4:
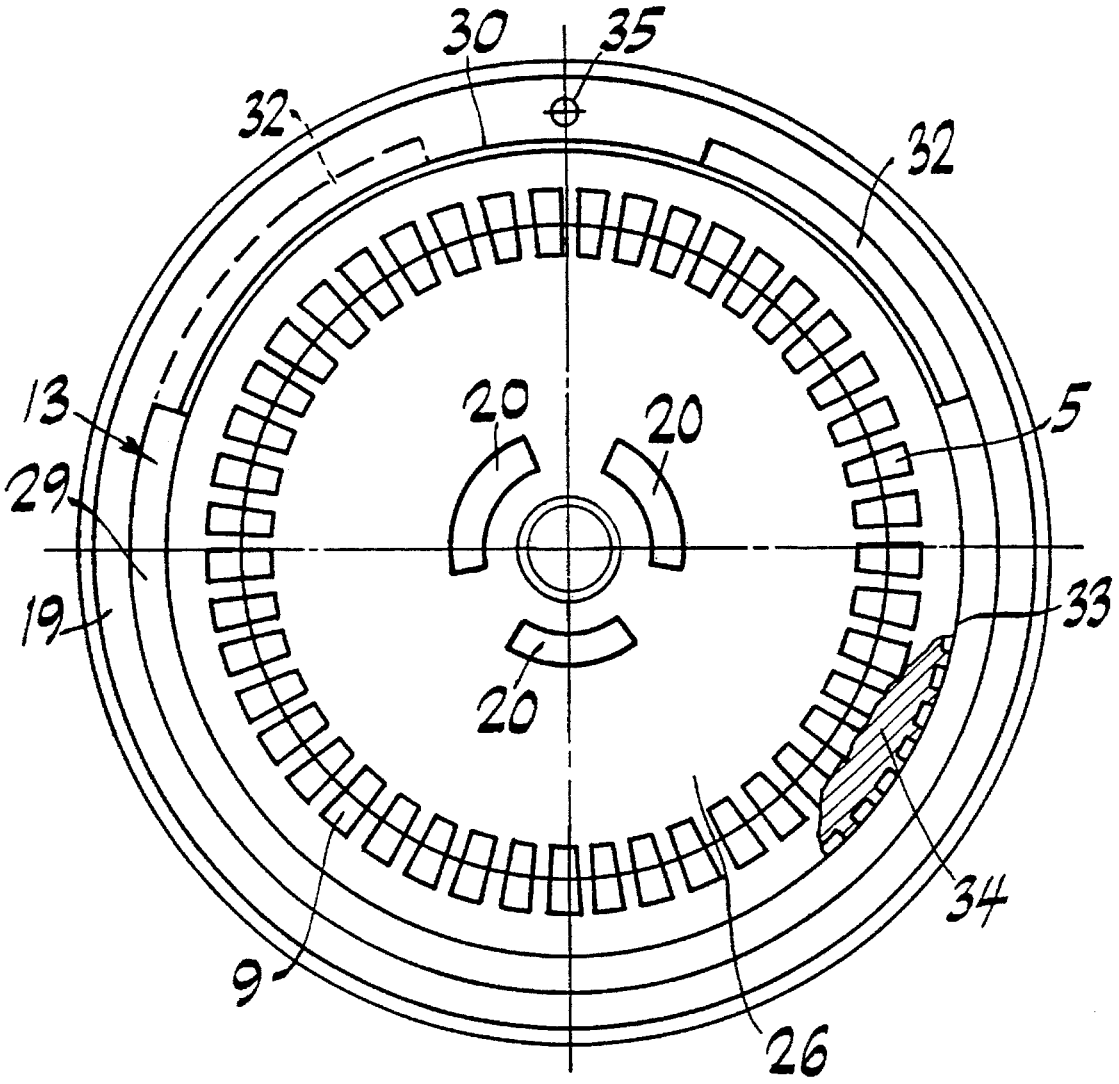

FIG. 4 shows pump impeller 5 and part of pump wall 19, in which bore 30 for receiving pump impeller 5 as well as radial extension 29 for forming the connecting channel 13 are viewed in the same direction as FIG. 2, but axially displaced by the thickness of the pump impeller 5. Radial extension 29 is connected to channels 32 shown in solid lines at the right and hidden in the dotted lines at the left.

FIG. 4 also shows the blade ring 9 of the second pump stage on pump impeller 5 and slots 20 into which project one or more drivers 22 on motor armature 21 to drive pump impeller 5. The blade ring 34 is shown in a broken away portion of the outer surface 33 of pump impeller 5.

The fuel pump can be driven with a high degree of efficiency and with low noise and is suitable for use with internal combustion engines of vehicles.

Although the invention has been described in relation to a specific embodiment, it will be, apparent to those skilled in art that numerous modifications and variations can be made within the scope and spirit of the invention as defined by the attached claims.

What is claimed is:

1. An improvement in a fuel pump for an internal combustion engine in which the fuel pump comprises an electric motor over which fuel is pumped to cool the motor, and a pump mechanism, constituted as a side-channel pump is driven by the electric motor to pump the fuel, said pump mechanism having a pump impeller provided with two opposite radial surfaces each provided with an annular ring of blades respectively cooperating with side channels provided in a pump wall, the ring of blades and one side channel constituting a first pump stage and the ring of blades and the other side channel constituting a second pump stage, and a connecting channel connecting an inlet region of the side channel of the second pump stage with a discharge region of the side channel of the first pump stage, said discharge region and said inlet region being arranged to substantially eliminate torsional moments acting on the radial surfaces of the impeller during a fuel pumping operation, said improvement comprising:

a first flat region on the radial surface of said pump impeller in said first pump stage, a second flat region on the radial surface of said pump impeller in said second pump stage, first connection means for applying pressure of the fluid discharged from the second pump stage to said first flat region, and second connection means for applying pressure of the fluid discharged from the first pump stage to said second flat region, whereby a net axial force applied to the first and second flat regions of said pump impeller by the respective pressures of the fluid in the first and second stages substantially counterbalance a force produced on the pump impeller by the pressure of the fluid discharged from the first pump stage acting in the direction of the first pump stage.

2. The improvement as claimed in claim 1, wherein said electric motor comprises an armature drivingly coupled to said pump impeller, said armature including a shaft, said pump impeller having a hole in which said armature shaft is loosely supported.

3. The improvement as claimed in claim 1, wherein said first and second flat regions of said pump impeller are respectively bounded by first and second recesses in said pump wall.

4. The improvement as claimed in claim 3, wherein said first and second connection means are respectively connected to said first and second recesses.

5. The improvement as claimed in claim 4, wherein said first and second connection means respectively include channels connected to said first and second recesses.

6. The improvement as claimed in claim 5, wherein said channels are grooves.

7. The improvement as claimed in claim 5, wherein said channels are bores.

8. The improvement as claimed in claim 4, wherein said pumps wall has a bore in which said pump impeller is rotatably received, said second connection means comprising a channel connecting said discharge region of the first pump stage to the inlet region of the second pump stage, at least a portion of said channel being formed as a radial extension of a corresponding portion of said bore.

9. The improvement as claimed in claim 4, wherein said second connection means comprises a connecting channel connecting said discharge region of the first pump stage to the inlet region of the second pump stage, said one side channel of said first pump stage including an intermediate portion connected to and displaced radially from said discharge region of said one side channel of said first pump stage, said connecting channel having a portion complementary to said intermediate portion and in communication therewith.

10. The improvement as claimed in claim 9, wherein said intermediate portion of said one side channel of said first pump stage is displaced radially outward of said discharge region of said first pump stage.

11. The improvement as claimed in claim 10, wherein a portion of said connecting channel is formed as a radial extension of a corresponding portion of said bore, said portion of said connecting channel being connected to aid intermediate portion.

12. The improvement as claimed in claim 11, wherein said pump gear has an outer surface bounding said connecting channel, said outer surface having friction producing means thereon.

13. The improvement as claimed in claim 12, wherein said friction producing means comprises a ring of blades on said outer surface.

14. The improvement as claimed in claim 1, wherein said armature includes a driver engaged in a slot in said pump impeller to drive the impeller in rotation, said driver being fitted in said slot with radial clearance, said first connection means comprising a passage formed by the clearance of the driver in said slot, said passage being connected to a chamber communicating with a discharge outlet of said second pump stage.

* * * * *